US006658776B1

(12) United States Patent
Pynenburg et al.

(10) Patent No.: US 6,658,776 B1
(45) Date of Patent: Dec. 9, 2003

(54) MODULAR BULKHEAD DISPLAY SYSTEM

(75) Inventors: Adrian W. Pynenburg, Brantford (CA); Martin S. Cross, Brantford (CA)

(73) Assignee: StoreImage Programs Inc., Brantford (CA)

( * ) Notice: Subject to any disclaimer, the term of this patent is extended or adjusted under 35 U.S.C. 154(b) by 172 days.

(21) Appl. No.: 09/782,430

(22) Filed: Feb. 13, 2001

(51) Int. Cl.[7] ..... G09F 7/00; G09F 7/22
(52) U.S. Cl. ..... 40/605; 40/611; 40/617
(58) Field of Search ..... 40/605, 611, 617, 40/649, 651, 729, 730; 52/38, 582.1, 690, 582.2, 578

(56) References Cited

U.S. PATENT DOCUMENTS 4,656,766 A * 4/1987 Cooper ..... 40/605
5,419,134 A * 5/1995 Gibson ..... 248/223.41
5,537,766 A * 7/1996 Nickens et al. ..... 160/135
5,666,751 A * 9/1997 Garfinkle ..... 40/605
6,076,295 A * 6/2000 Garfinkle ..... 40/605

FOREIGN PATENT DOCUMENTS

DE 2844240 * 4/1980 ..... 40/605

* cited by examiner

*Primary Examiner*—Brian K. Green

(57) ABSTRACT

A modular bulkhead display system containing a first end panel, a first intermediate panel, and a second end panel, each of which is an aluminum extrusion. Within the aluminum extrusion there is a first external channel, a second external channel, and a center channel. A decor panel is removably disposed within said external channel, and another decor panel may be disposed within the second external channel. End caps are removably connected to the assembly.

19 Claims, 4 Drawing Sheets

MODULAR BULKHEAD DISPLAY SYSTEM

FIELD OF THE INVENTION

A modular bulkhead display system for use in a retail environment.

BACKGROUND OF THE INVENTION

In retail environments which utilize display cases, such as delicatessens, a bulkhead is often disposed above the display case. The bulkhead often displays one or more advertising messages; and it furnishes a pleasing appearance to the display area.

Most prior art bulkhead assemblies are permanent structures, often made of drywall and studding; and their appearances cannot readily be changed; and they are time consuming and costly to produce. As a display area within a store changes, or as the items being displayed change, it is difficult to modify the prior art bulkhead assemblies to accommodate changing realities.

The prior art bulkhead assemblies are not capable of displaying advertising on both of their sides and, thus, cannot readily be used in the middle of a store.

It is an object of this invention to provide a modular bulkhead display system which is relatively lightweight, can readily be configured to a variety of retail situations, and can easily be moved from one retail location to another.

SUMMARY OF THE INVENTION

In accordance with this invention, there is provided a modular bulkhead display system comprised of a first end panel, a first intermediate panel, a second intermediate panel, means for locking said first end panel to said first intermediate panel, means for locking said second end panel to said second intermediate panel, means for supporting and hanging said first end panel, means for supporting and locking said first intermediate panel, means for supporting and hanging said second intermediate panel, and means for supporting and hanging said second end panel. Each of the panels contains a removable decor panel.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
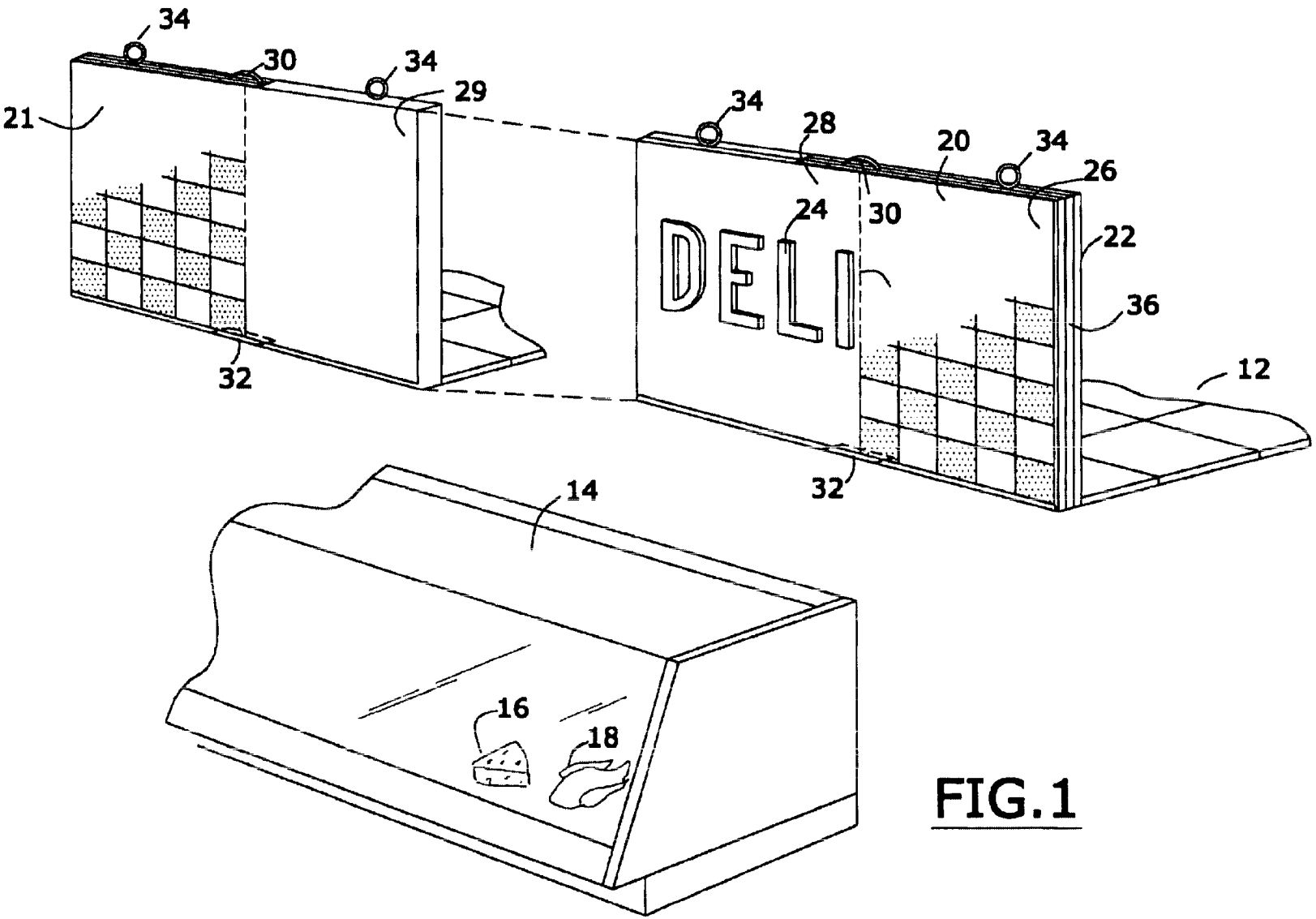
FIG. 1 is a partial perspective view of one preferred embodiment of the modular bulkhead display system of the invention.

FIG. 1 is a partial perspective view of one preferred embodiment of applicant's modular bulkhead display system 10 disposed in a store and mounted above a display case 14.

The modular display system 10 is comprised of a first decor board 20 disposed on the front of the assembly 10, and a second decor board 22 disposed at the back of the assembly 10. Each of decor boards 20 and 22 may be removed from assembly 10 and replaced with other decor boards. Thus, when assembly 10 is utilized in the middle of a store, it can display graphic indicia (like indicia 24) in two directions simultaneously. In the application depicted in FIG. 1, however, there is no need for decor board 22 (inasmuch as it is not visible to the public); and such decor board 22 may be omitted.

Referring again to FIG. 1, and in the preferred embodiment depicted therein, it will be seen that modular bulkhead assembly is comprised of a first end panel 26 removably connected to a first intermediate panel 28 by means of snap locks 30 and 32; the point at which these two panels are contiguous is indicated by dotted line 27. As will be apparent to those skilled in the art, by varying the sizes of the end panels 26 and the intermediate panels 28, as well as their a, displays on decor boards 20 and/or 22, one can construct a huge variety of displays of different sizes.

The panels 26 and 28 may be constructed in wide variety of sizes. In one embodiment, these panels have lengths ranging from about 3 to about 6 feet and, preferably, from about 4 to about 6 feet. The panels generally will have a height of from about 2 to about 8 feet.

The panels 26 and 28 are comprised of extruded metal, such as extruded aluminum. Consequently, they are relatively lightweight, ranging from about 5 to about 15 pounds per panel.

Most of the systems 10 will utilize a left end panel 24, a right end panel 26, and at least two intermediate panels 28, 29. It is preferred to utilize from about 2 to about 20 such intermediate panels 28, 29, each removably connected to each other by means of snap locks 30 and 32.

In the preferred embodiment depicted in FIG. 1, each of the decor boards 22 and 22 are disposed within an exterior channel formed in the panels (not shown in FIG. 1). Each of the panels preferably contains a hook 34 for securing the panel to a ceiling, and the hook is part of a hook/support assembly (not shown in FIG. 1) which is disposed within a central channel 36 formed in the panels.

Figure 2:
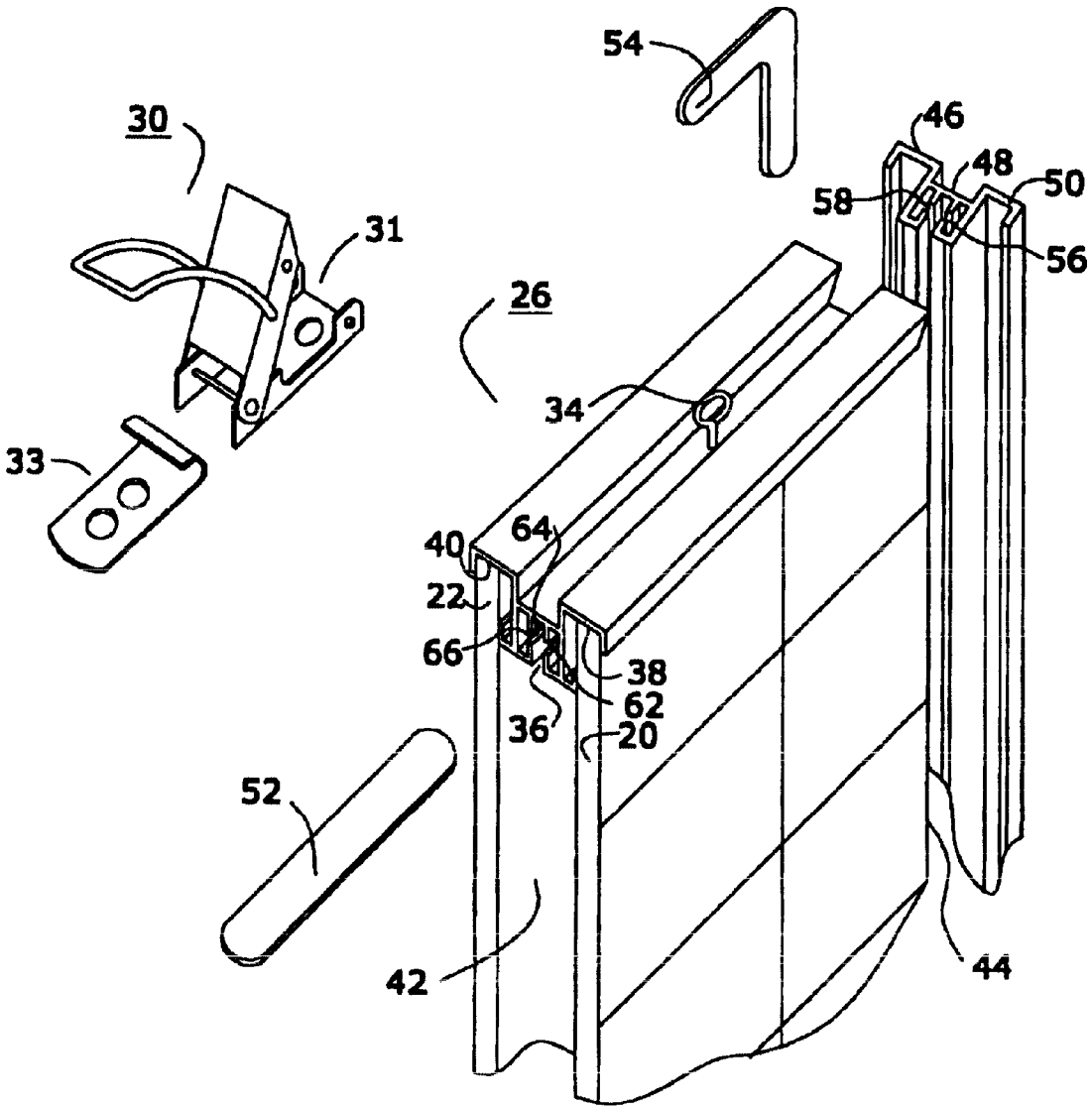
FIG. 2 is a partial exploded view of the bulkhead display system of FIG. 1.

FIG. 2 is an exploded view of the panel 26 of FIG. 1. Referring to FIG. 2, it will be seen that panel 26 is comprised of a first external channel 38 (in which decor board 20 is disposed), a second external channel 40 (in which decor board 22 is disposed), and an intermediate channel 36. The same channel appears at both end 42 and end 44 of the uncapped channel 36. What makes panel 26 an end panel is that the channels 36, 38, and 40 are capped at the end 44 by mitered cap assembly 46/48/50. Without such structure the panel 26 illustrated in FIG. 2 would be an intermediate channel capable of receiving connector spline 52 at both of its ends 42 and 44.

In order to connect the uncapped panel 26 to the mitered caps 46, 48, and 50, a pair of corner brackets 54 is inserted into slots 56 and 58 and into corresponding slots appearing at end 44. These corresponding slots are similar in structure to the slots 60 and 62 appearing at end 42.

When two or more intermediate panels are to be joined, they are joined by means of both lock 30 and connector spline 52. One portion of lock 30, snap lock 31, is connected to one of the panels, the other portion of lock 30, clasp 33, is connected to the other of the panels, and the interaction of these two parts removably locks the two panels together. As is illustrated in FIG. 1, it is preferred to use both a top locking assembly 30 and a bottom locking assembly 32 to removably connected two adjacent panels.

Referring again to FIG. 2, the connector spline 52 slides into adjacent slots 64 and, when so engaged, helps support adjacent panels. The connector spline 52 is so configured that it is retained by friction within slot 64.

Figure 3:
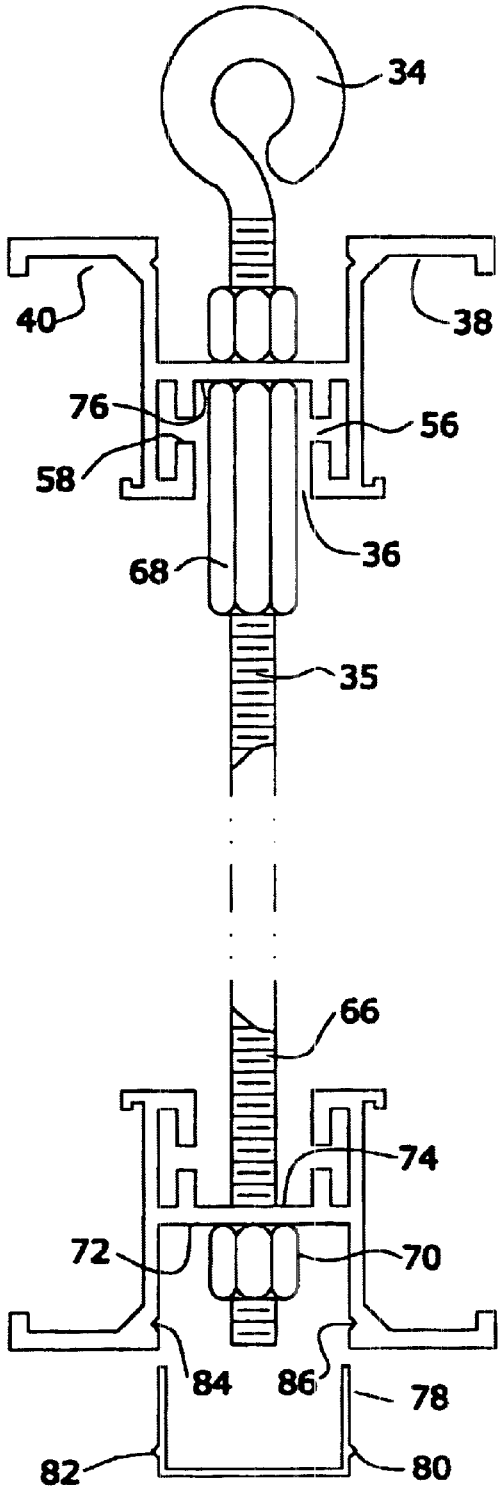
FIG. 3 is a sectional view of the modular bulkhead display system of the invention illustrating the preferred means for supporting and hanging the panels of the bulkhead display system.

FIG. 3 is a sectional view of a portion of the assembly 10 of FIG. 1. As will be seen more clearly in FIG. 3, the first external channel 38 is adapted to receive decor board 20 (not shown), the second external channel 40 is adapted to receive decor board 22 (not shown), and the support/hanging assembly 35 is disposed within intermediate (center) channel 36.

The hook assembly 35 is comprised of hook 34 connected to support 66. A threaded coupling 68 receives and engages with both hook assembly 34 and threaded rod 35. Threaded rod 35 is captured by nut 70 at end 72 of the panel. As will be apparent, as the threaded rod 35 is turned clockwise or counterclockwise, the amount of force (and support) provided to the surfaces 74 and 76 of the panel can be varied.

As will be seen by reference to FIG. 2, slots 56 and 58 are adapted to receive corner brackets 54, which can be used to attach mitered caps 46, 48, and 50 to the panel to convert an intermediate panel into an end panel. In the preferred embodiment depicted in FIG. 2, mitered caps 46, 48 and 50 comprise one integral assembly.

A cover cap 78 may be friction fit into center channel 36 to conceal the support assembly 34/35/70. Cover cap 78 may be made from plastic such as, e.g., flexible polyvinyl chloride. In the embodiment depicted, it contains two nubs adapted to engage with nibs 84 and 86.

Figure 4:
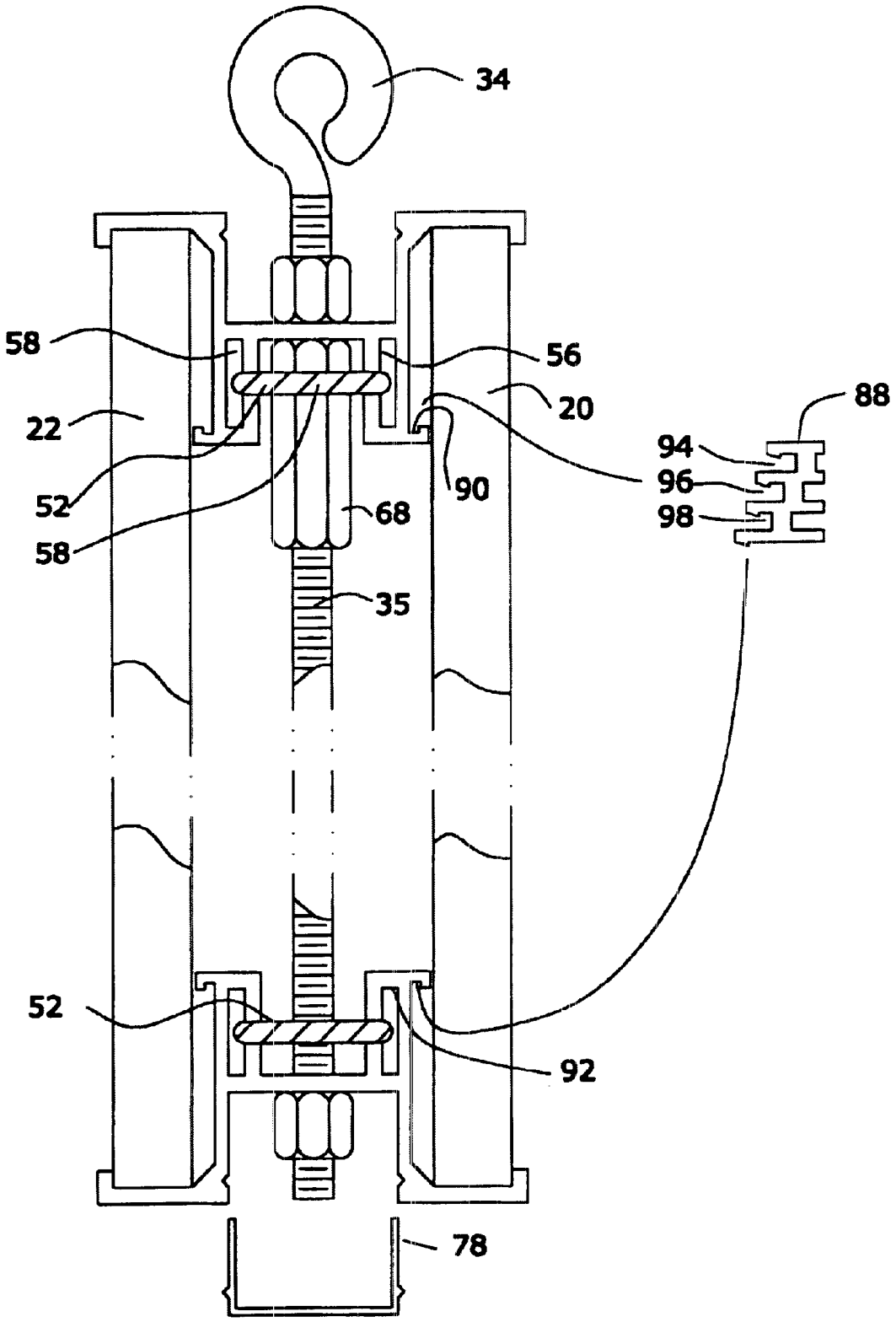
FIG. 4 is a sectional view of the modular bulkhead display system of FIG. 1.

FIG. 4 is a sectional view, similar to that of FIG. 3, in which the connector splines 52 are shown in sectional view. The connector splines 52 are preferably securely friction fit within slot 51 and provide additional support and engagement between adjacent panels.

An panel thickness adaptor 88 may be connected at point 90 and/or point 92 to adjust for the use of panels 20 and/or 22 which are not substantially the same thickness as the external channels 38 and 40. The panel thickness adaptor 88 may be used by friction fitting it into place at points 90 and/or 92 using either slot 94, 96, and/or 98. As will be apparent, depending upon which such slot is used, the extent to which the adaptor 88 compensates for a thin decor panel 20 or 22 can be varied.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A modular bulkhead display system comprised of a first end panel, a first intermediate panel, and a second end panel, a first locking mechanism for removably connecting said first end panel to said first intermediate panel said first locking mechanism including a snap lock on one of the first panels which interacts with a clasp on the other of the first panels to removably secure the first end panel to the first intermediate panel, means for supporting and hanging said first end panel, means for supporting and hanging said first intermediate panel, and means for supporting and hanging said second end panel, wherein:

(a) each of said first end panel, said second end panel, said first intermediate panel, is comprised of an aluminum extrusion comprising a first external channel, a second external channel, and a center channel, wherein:

1. a first decor panel is removably disposed within said first external channel,
2. said first end panel is comprised of a proximal end and a distal end, wherein a mitered cap is removably connected to said proximal end of said first end panel,
3. said second end panel is comprised of a proximal end and a distal end, wherein a mitered cap is removably connected to said proximal end of said second end panel,
4. each of said first end panel, said second end panel, and said first intermediate panel weighs from about 5 to about 15 pounds.

2. The modular bulkhead display system as recited in claim 1, wherein disposed within said center channel is a first longitudinally-extending slot and a second longitudinally-extending slot.

3. The modular bulkhead display system as recited in claim 1, wherein said modular bulkhead system is comprised of a second intermediate panel.

4. The modular bulkhead display system as recited in claim 1, wherein a second decor panel is removably disposed within said second external channel.

5. The modular bulkhead display system as recited in claim 1, wherein said first end panel is removably connected to said first intermediate panel by means of a first connector spline.

6. The modular bulkhead display system as recited in claim 5, wherein said first end panel is removably connected to said first intermediate panel by means of a second connector spline.

7. The modular bulkhead display system as recited in claim 1, wherein said modular bulkhead system is comprised of said first end panel, said second end panel, and from about 2 to about 20 intermediate panels.

8. The modular bulkhead display system as recited in claim 1, wherein said means for supporting and hanging said first end panel comprises a hook.

9. The modular bulkhead display system as recited in claim 8, wherein said means for hanging and supporting said first end panel comprises a threaded coupling connected to said hook.

10. The modular bulkhead display system as recited in claim 9, wherein said means for hanging and supporting said first end panel comprises a threaded rod connected to said threaded coupling.

11. The modular bulkhead display system as recited in claim 1, wherein said mitered cap are removably connected to said proximal end of said first end panel by means of a first corner bracket and a second corner bracket.

12. The modular bulkhead display system as recited in claim 11, wherein said mitered cap are removably connected to said proximal end of said second end panel by means of a third corner bracket and a fourth corner bracket.

13. The modular bulkhead display system as recited in claim 1, wherein said system further comprises a cover cap removably connected to said center channel of said aluminum extrusion.

14. The modular bulkhead display system as recited in claim 13, wherein said cover cap is comprised of flexible plastic material.

15. The modular bulkhead display system as recited in claim 1, wherein said lock is connected to a first panel.

16. The modular bulkhead display system as recited in claim 1, wherein said clasp is connected to a second panel.

17. The modular bulkhead display system as recited in claim 16, wherein said lock pivotally attaches to said clasp.

18. The modular bulkhead display system as recited in claim 17, wherein said lock and said clasp are reversibly locked in a closed position.

19. The modular bulkhead display system as recited in claim 1, further comprised of a second locking mechanism.

* * * * *